US005582333A

United States Patent [19]

Bennett

[11] Patent Number: 5,582,333

[45] Date of Patent: Dec. 10, 1996

[54] NAIL POLISH REMOVER PRODUCT

[75] Inventor: Robert Bennett, Easton, Conn.

[73] Assignee: Chesebrough-Pond's USA Co., Division of Conopco, Inc., Greenwich, Conn.

[21] Appl. No.: 405,640

[22] Filed: Mar. 17, 1995

[51] Int. Cl.[6] ..... B67D 3/00

[52] U.S. Cl. ..... 222/546; 222/556; 222/568

[58] Field of Search ..... 222/212, 545, 222/546, 556, 568

[56] References Cited

U.S. PATENT DOCUMENTS

| | | | |
|---|---|---|---|
| 2,625,306 | 1/1953 | Murphy | 222/545 X |
| 2,726,796 | 12/1955 | Aldridge | 222/545 |
| 3,059,816 | 10/1962 | Goldstein | 222/109 |
| 3,122,289 | 2/1964 | Prahl, Jr. | 222/566 |
| 3,204,829 | 9/1965 | Song | 222/153 X |
| 3,220,618 | 11/1965 | Lodding et al. | 222/416 |
| 3,337,900 | 8/1967 | Schwartzman | 222/212 X |
| 3,877,598 | 4/1975 | Hazard | 222/546 X |
| 4,106,672 | 8/1978 | Tecco et al. | 222/151 |
| 4,190,180 | 2/1980 | Bennet | 222/207 |
| 4,358,032 | 11/1982 | Libit | 222/546 X |
| 4,377,248 | 3/1983 | Stull | 222/546 X |
| 4,801,049 | 1/1989 | Thompson | 222/382 X |
| 5,246,139 | 9/1993 | Duceppe | 222/207 X |
| 5,253,793 | 10/1993 | Bolen, Jr. et al. | 222/556 X |

*Primary Examiner*—Joseph Kaufman
*Attorney, Agent, or Firm*—Milton L. Honig

[57] ABSTRACT

A nail polish remover product is provided formed of a liquid nail polish remover composition and a dispenser for storing and delivering the composition. A volatile solvent such as acetone or ethyl acetate usually forms a significant portion of the composition. The dispenser will include a bottle and a cap. The bottle will have a mouth at an open end thereof which is provided with a coupling mechanism such as a male screw thread to lock the cap. The cap has a deck to cover the bottle mouth, a female screw thread to lockingly engage the thread around the mouth, a skirt surrounding the deck and a lid hingedly attached to the skirt. The deck is concave shaped with an aperture centered therein allowing dispensing of the composition from the bottle when the lid is in an open position but preventing dispensing when the lid is in a closed position.

16 Claims, 2 Drawing Sheets

NAIL POLISH REMOVER PRODUCT

BACKGROUND OF THE INVENTION

1. Field of the Invention

The invention concerns a nail polish remover composition in a container with a special dispensing cap.

2. The Related Art

Nail polish remover compositions consist essentially of one or more solvents capable of dissolving a nail applied lacquer. Typically, the solvent will be a relatively volatile material such as acetone or ethyl acetate. More recently, some of the volatile solvent has been replaced by water, glycols and other less volatile liquids to comply with environmental regulations.

Traditional packaging for nail polish remover has been a narrow-neck bottle with a relatively wide opening covered by a screw-on cap. Over time some aesthetic and functional improvements have been added to the packaging. For instance, most commercial bottles are now bell-shaped and have grip lines along the narrowest section of the neck. Consumers can thus more securely hold the bottle. Beyond these changes, there has been little further improvement.

In using a polish remover product, the consumer normally requires a two-handed operation with one hand to hold the bottle and the other to unscrew the cap. Thereafter, a cotton ball is usually placed across the bottle mouth, the bottle is slightly inverted and the cotton ball allowed to absorb polish remover liquid. The consumer must then two-handedly replace the cap while balancing the soaked cotton ball or alternatively leave the bottle open resulting in solvent evaporating. The procedure is clearly cumbersome, results in loss of solvent and pollutes the air.

Sometimes application of the cotton ball to the open mouth of the bottle results in spillage. At the very least, the transfer technique is highly variable in its delivery of solvent remover to cotton ball. There is an evident need for an improved system in delivering nail polish remover to a consumer's nails.

Accordingly, it is an object of the present invention to provide a nail polish remover product which avoids spillage of remover and minimizes volatilization losses.

Another object of the present invention is to provide a nail polish remover product that can be manipulated with a single hand in opening and closing the product container.

Still another object of the present invention is to provide a nail polish remover product whose container is fitted with a cap for controlling the amount of solvent delivered to an applied cotton ball and offers a mating surface between the cotton ball and product container orifice.

SUMMARY OF THE INVENTION

A nail polish remover product is provided that includes:

- a liquid nail polish remover composition at least one component of which is a volatile solvent present in an effective amount to remove lacquer from nail surfaces;
- a dispenser for storing and delivering the liquid composition that includes:
  - a bottle containing the liquid composition having a closed end and an open end, the open end being provided with a mouth and a mechanism for coupling a closure thereto; and

- a cap including a deck to cover the mouth of the bottle, a mechanism for fastening the cap to the closure coupling mechanism, a skirt circumferentially surrounding the deck, and a lid hingedly attached to the skirt, the deck being concave shaped with an aperture centered therein allowing dispensing of the liquid composition from the bottle when the lid is in an open position but preventing dispensing when the lid is in a closed position.

The lid will have an inner surface facing the deck. In a preferred embodiment, a finger projects downwardly from the inner surface of the lid toward the bottle. In the closed position of the lid, the finger mates with the aperture to seal against leakage of the liquid composition from the bottle. The inner surface is preferably of a concave shape congruent with that of the deck. The lid has an outer surface opposite the inner surface which may also be of a concave shape. Preferably, however, the outer surface of the lid may be of a flat planar shape to avoid the dust collecting propensity of a concave shaped outer surface.

The dispenser cap should be formed of a plastic resistant to attack by volatile organic solvents, especially dissolution by acetone. Examples of suitable plastics include polyethylene, polypropylene and polyethylene terephthalate.

The volatile solvent should have a boiling point lower than 100° C., preferably below 50° C. Acetone and ethyl acetate are the preferred solvents.

BRIEF DESCRIPTION OF THE DRAWING

The above features, advantages and objects of the present invention will more fully be appreciated through the following detailed discussion, reference being made to the drawing consisting of.

DETAILED DISCUSSION

Nail polish remover products of the present invention are formed from the combination of a liquid nail polish remover composition and a special dispenser. The composition will include as an essential element a volatile organic solvent having from 2 to 10 carbon atoms with a vapor pressure of more than 0.1 mm, preferably of more than 0.5 mm at 20° C. Illustrative solvents include acetone, methyl ethyl ketone, ethyl acetate and combinations thereof. Most preferred is acetone. Amount of the solvent will range from about 1 to about 100%, preferably from about 50 to about 85%, optimally from about 60 to about 75% by weight.

$C_2$-$C_8$ alkylene carbonate may be present as a volatile co-solvent. Illustrative are ethylene carbonate and propylene carbonate. Amounts of the alkylene carbonate may range from about 1 to about 30%, preferably from about 3 to about 20%, optimally from about 5 to about 10% by weight.

Humectants may also be incorporated into compositions of the present invention. Examples include water, glycerin, diglycerin, ethyl alcohol, methyl alcohol, isopropyl alcohol, polyethylene glycol, propylene glycol, sorbitol, dimethyl isosorbide and combinations thereof. Amounts of these components may range from about 0.1 to about 80%, preferably from about 5 to 40% by weight of the total composition.

Emollients such as fatty acid esters, mineral oil, silicone oil, lanolin and lanolin derivatives may also be present in amounts from about 0.01 to about 5% by weight of the total composition.

Minor other functional components may also be present. These include acidulants such as citric acid, buffers, vitamins A, B and E, panthenol, gelatin, hydrolyzed proteins and UV absorbers such as Oxybenzone and ethyl hexyl p-methoxycinnamate.

Figure 1:
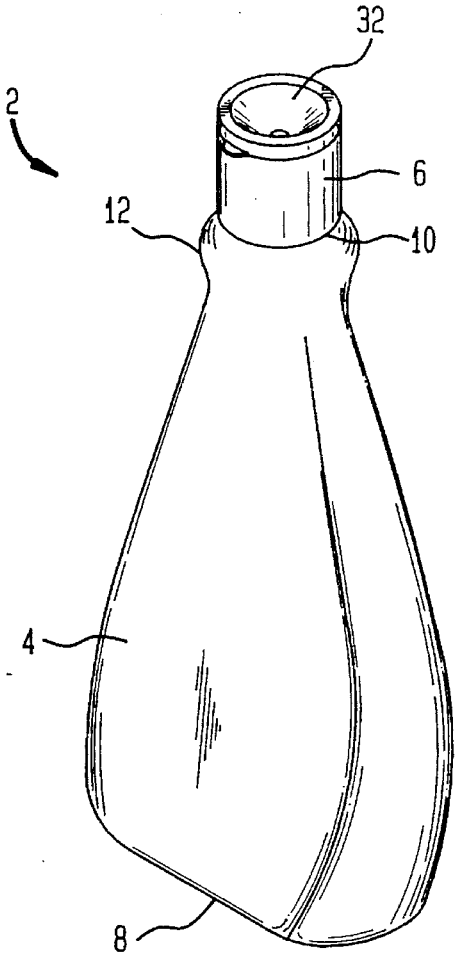
FIG. 1 which is a plan perspective view of the dispenser according to the present invention.
Figure 2:
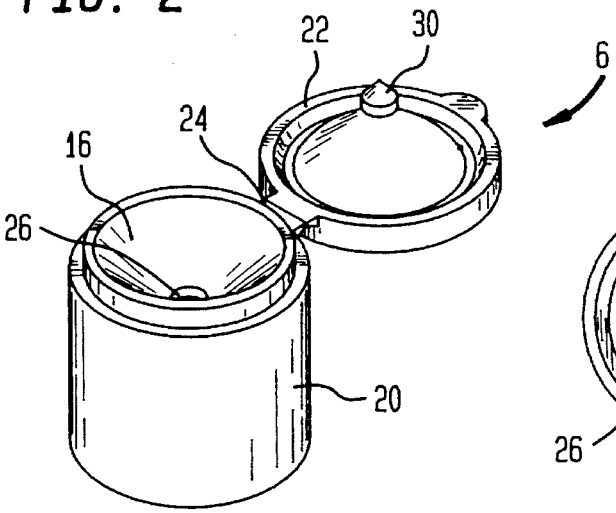
FIG. 2 which is a plan perspective view of the cap portion of the dispenser with the lid in an open position.
Figure 3:
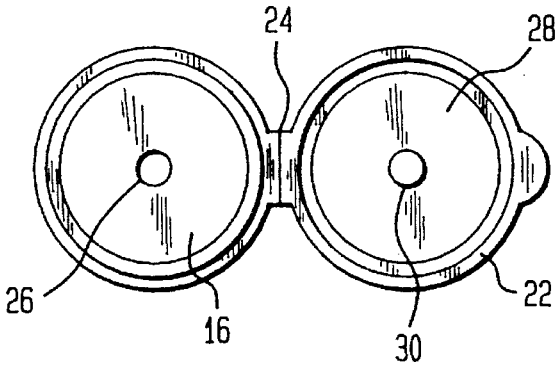
FIG. 3 which is a top plan view of the cap according to FIG. 2.
Figure 4:
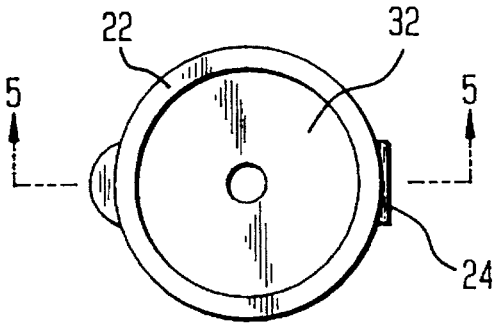
FIG. 4 which is a top plan view of the cap according to FIG. 1.

FIG. 1 illustrates a dispenser 2 that includes a bottle 4 and a cap 6, the dispenser being capable of holding nail polish remover compositions of the present invention. Bottle 4 holds the liquid nail polish remover composition and is characterized by a closed end 8 and an open end 10. Open end 10 is provided with a mouth 12 and a male screw thread 14 serving as a coupling mechanism to attaching cap 6.

The cap 6 includes a deck 16 to cover the bottle mouth, a female screw thread 18 serving as a fastening mechanism to sealingly couple with the male screw thread 14, a skirt 20 surrounding the deck 16, and a lid 22. A hinge 24 attaches lid 22 to the skirt 20. Deck 16 is concave shaped with an aperture 26 centered therein. Aperture 26 allows dispensing of the composition from the bottle when the lid is in an open position but prevents dispensing when the lid is in a closed position.

Figure 6:
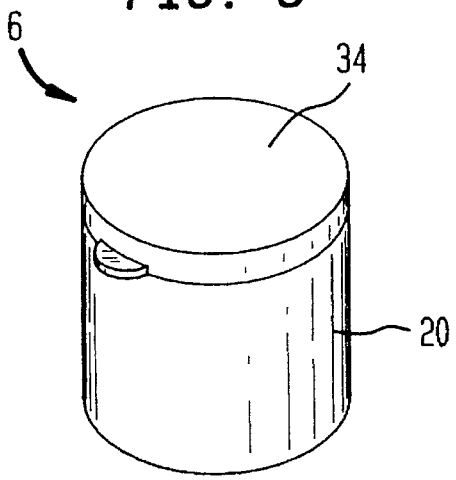
FIG. 6 which is a second embodiment of the cap wherein the outer surface of the lid is flat.
Figure 5:
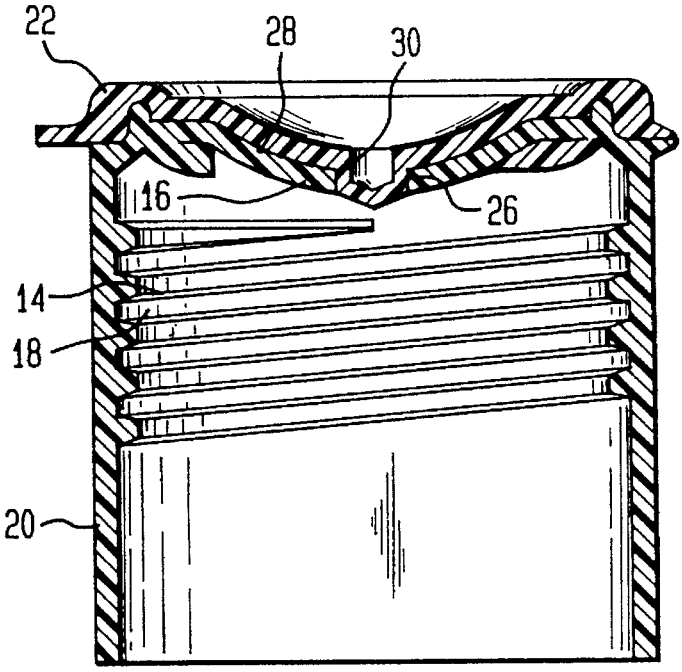
FIG. 5 which is a cross-sectional view of the cap taken along line 5—5 of FIG. 4.

Lid 22 has an inner surface 28 facing deck 16. A finger 30 projects downwardly from the inner surface 28 toward the bottle. FIG. 5 illustrates the closed position of the lid 22 mating with aperture 26 to seal against leakage of the liquid composition from the bottle. This Figure also illustrates surface 28 as being concave shaped and congruent with that of the deck. Lid 22 has an outer surface 32 opposite the inner surface 28 which also is of a concave shape. Alternatively, lid 22 has a flat planar shaped outer surface 34 as best illustrated in FIG. 6.

Liquid nail polish remover compositions of the present invention are applied to a person's nails to remove nail polish lacquer with the assistance of a cotton ball. A user will grab the dispenser around the bottle neck and, with the same hand, through thumb action flip open the cap lid. With the free hand, the user will apply a cotton ball to fit within the concave shaped deck of the lid. Thereupon the dispenser is tilted to allow liquid remover composition to flow through the aperture onto the cotton ball. Removal of the ball is then followed by single handed flipping of the lid back into its closed position. Once the dispenser is safely closed, the user can begin the lacquer removal process by scrubbing the nails with the solvent impregnated cotton ball.

The dispensing cap of products according to the present invention avoids the necessity of using two hands simultaneously in either the opening or closing process. Solvent is thereby prevented from evaporating through the open mouth of the dispenser bottle, spillage is avoided and solvent is more accurately dosed to the cotton ball.

The following examples will more fully illustrate composition embodiments of this invention. All parts, percentages and proportions referred to herein and in the appended claims are by weight of the total composition unless otherwise stated.

EXAMPLE 1

A composition typical of the present invention is outlined in Table I.

TABLE 1

| INGREDIENT | WEIGHT % |
|---|---|
| Acetone | 75–85 |
| Water | 10–15 |
| Glycerin | 18–8 |
| Lytron 621 | 0.5–2 |
| Fragrance and Color | 0.5–2 |
| Mineral Oil | 0.01–0.5 |
| Carbopol 934 (2% dispersion) | 0.01–0.5 |
| Propylene Glycol | 0.01–0.5 |
| Stearic Acid | 0.01–0.5 |
| Glycercol Stearate | 0.01–0.5 |
| Cetyl Acetate | 0.01–0.3 |
| Triethanolamine | 0.01–0.3 |
| Glycerol Stearate | 0.01–0.2 |
| Cetyl Alcohol | 0.01–0.1 |
| Methyl Paraben, Propyl Paraben and Disodium EDTA | 0.01–0.1 |
| Magnesium Aluminum Silicate (Veegum) | 0.01–0.05 |
| Silicone Fluid | 0.01–0.05 |

EXAMPLE 2

Another composition typical of the present invention is outlined in Table II.

TABLE II

| INGREDIENT | WEIGHT % |
|---|---|
| Acetone | 85.0 |
| Glycerin | 1.5 |
| Diglycerin | 1.5 |
| Colorant | 0.2 |
| Fragrance | 0.2 |
| Hydrolyzed Protein | 0.1 |
| Water | qs |

EXAMPLE 3

A further composition typical of the present invention is outlined in Table III.

TABLE III

| INGREDIENT | WEIGHT % |
|---|---|
| Acetone | 70.0 |
| Glycerin | 1.5 |
| Diglycerin | 1.5 |
| Colorant | 0.4 |
| Fragrance | 0.2 |
| Citric Acid | 0.05 |
| Vitamin E Acetate | 0.01 |
| Gelatin | 0.0001 |
| Panthenol | 0.0001 |
| Water | qs |

EXAMPLE 4

A still further composition typical of the present invention is outlined in Table IV.

TABLE IV

| INGREDIENT | WEIGHT % |
|---|---|
| Ethyl Acetate | 85.0 |
| Glycerin | 1.5 |
| Diglycerin | 1.5 |
| Fragrance | 0.2 |
| UVINUL 400 ® | 0.2 |
| Colorant | 0.1 |
| Gelatin | 0.001 |
| Water | qs |

EXAMPLE 5

Another composition typical of the present invention is outlined in Table V.

TABLE V

| INGREDIENT | WEIGHT % |
|---|---|
| Acetone | 60.0 |
| Glycerin | 10.0 |
| Colorant | 0.2 |
| Fragrance | 0.2 |
| Gelatin | 0.1 |
| Water | qs |

The foregoing description and Examples illustrate selected embodiments of the present invention and in light thereof various modifications will be suggested to one skilled in the art, all of which are within the spirit and purview of this invention.

What is claimed is:

1. A nail polish remover product comprising:

a liquid nail polish remover composition comprising a volatile solvent present in an effective amount to remove lacquer from nail surfaces;

a dispenser for storing and delivering the liquid composition comprising:

a bottle holding the liquid composition having a closed end and an open end, the open end being provided with a mouth; and a cap including a deck to cover the mouth of the bottle, a skirt circumferentially surrounding the deck, and a lid hingedly attached to the skirt, the bottle including a means around the open end for coupling the cap thereto and a means on the cap for fastening same to the coupling means, the deck being concave shaped with an aperture centered therein allowing dispensing of the liquid composition from the bottle and allowing return of excess liquid composition to the bottle when the lid is in an open position but preventing dispensing when the lid is in a closed position.

2. A product according to claim 1 wherein the lid has an inner surface facing the deck and further comprises a finger projecting downwardly from the inner surface toward the bottle and in the closed position of the lid mates with the aperture to seal against leakage of the liquid composition from the bottle.

3. A product according to claim 2 wherein the inner surface has a concave shape and is congruent with that of the deck.

4. A product according to claim 3 wherein the lid has an outer surface opposite the inner surface, the outer surface being of a concave shape.

5. A product according to claim 3 wherein the lid has an outer surface opposite the inner surface, the outer surface being of a flat planar shape.

6. A product according to claim 1 wherein the dispenser cap is formed of a plastic selected from the group consisting of polyethylene, polypropylene and polyethylene terephthalate.

7. A product according to claim 1 wherein the volatile solvent has a boiling point lower than 100° C.

8. A product according to claim 7 wherein the volatile solvent is present in an amount from about 1 to about 100% by weight of the composition.

9. A product according to claim 1 wherein the volatile solvent is selected from the group consisting of acetone, methyl ethyl ketone, ethyl acetate and mixtures thereof.

10. A product according to claim 1 wherein the composition further comprises from about 0.1 to about 80% of a humectant selected form the group consisting of water, glycerin, diglycerin, ethyl alcohol, methyl alcohol, isopropyl alcohol, polyethylene glycol, propylene glycol, sorbitol, dimethyl isosorbide and mixtures thereof.

11. A dispenser for a nail polish remover product comprising:

a bottle for holding a liquid nail polish remover composition having a closed end and an open end, the open end being provided with a mouth; and a cap including a deck to cover the mouth of the bottle, a skirt circumferentially surrounding the deck, and a lid hingedly attached to the skirt, the bottle including a means around the open end for coupling the cap thereto and a means on the cap for fastening same to the coupling means, the deck being concave shaped with an aperture centered therein allowing dispensing of the liquid composition from the bottle and allowing return of excess liquid composition to the bottle when the lid is in an open position but preventing dispensing when the lid is in a closed position.

12. A dispenser according to claim 11 wherein the lid has an inner surface facing the deck and further comprises a finger projecting downwardly from the inner surface toward the bottle and in the closed position of the lid mates with the aperture to seal against leakage of the liquid composition from the bottle.

13. A dispenser according to claim 12 wherein the inner surface has a concave shape and is congruent with that of the deck.

14. A dispenser according to claim 13 wherein the lid has an outer surface opposite the inner surface, the outer surface being of a concave shape.

15. A dispenser according to claim 14 wherein the lid has an outer surface opposite the inner surface, the outer surface being of a flat planar shape.

16. A dispenser according to claim 15 wherein the dispenser cap is formed of a plastic selected from the group consisting of polyethylene, polypropylene and polyethylene terephthalate.

* * * * *